US011738563B2

(12) United States Patent
Matsuda

(10) Patent No.: US 11,738,563 B2
(45) Date of Patent: Aug. 29, 2023

(54) PRINTER, PRINTING SYSTEM, AND PRINTING METHOD

(71) Applicant: SCREEN HOLDINGS CO., LTD., Kyoto (JP)

(72) Inventor: Takeshi Matsuda, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/677,093

(22) Filed: Feb. 22, 2022

(65) Prior Publication Data

US 2022/0288943 A1 Sep. 15, 2022

(30) Foreign Application Priority Data

Dec. 23, 2021 (JP) ..... 2021-208897

(51) Int. Cl.
*B41J 2/18* (2006.01)

(52) U.S. Cl.
CPC ..... *B41J 2/18* (2013.01)

(58) Field of Classification Search
CPC . B41J 2/17563; B41J 2/185; B41J 2/18; B41J 2/17596; B41J 2/175; B41J 2/17566; B41J 2/1721
See application file for complete search history.

(56) References Cited

U.S. PATENT DOCUMENTS

| | | | | |
|---|---|---|---|---|
| 8,366,224 | B2 | 2/2013 | Yokota et al. | |
| 10,486,430 | B2 * | 11/2019 | Shinhara | B41J 2/17596 |
| 10,583,662 | B2 * | 3/2020 | Yamada | B41J 2/14024 |
| 2020/0094572 | A1 | 3/2020 | Muto | |

FOREIGN PATENT DOCUMENTS

| | | | |
|---|---|---|---|
| EP | 3 628 495 | A1 | 4/2020 |
| JP | 2020-044823 | A | 3/2020 |
| WO | 2016/076082 | A1 | 5/2016 |

OTHER PUBLICATIONS

Extended European Search Report issued in corresponding European Patent Application No. 22160469.7-1014, dated Jun. 13, 2022.

* cited by examiner

*Primary Examiner* — An H Do
(74) *Attorney, Agent, or Firm* — McDermott Will & Emery LLP

(57) ABSTRACT

The buffer tank 98 whose atmosphere communicates with an atmosphere in the recovery tank 92 is provided. When an atmosphere in the supply tank 91 and an atmosphere in the recovery tank 92 communicate with each other, the difference between the positive pressure P1 inside the supply tank 91 and the negative pressure P2 inside the recovery tank 92 is cancelled. The negative pressure P3 occurs in the recovery tank 92 and the supply tank 91, and leakage of the ink from the nozzle N can be prevented.

6 Claims, 4 Drawing Sheets

PRINTER, PRINTING SYSTEM, AND PRINTING METHOD

CROSS REFERENCE TO RELATED APPLICATION

The disclosure of Japanese Patent Application No. 2021-037922 filed on Mar. 10, 2021 and No. 2021-208897 filed on Dec. 23, 2021 including specification, drawings and claims is incorporated herein by reference in its entirety.

BACKGROUND OF THE INVENTION

1. Field of the Invention

The present invention relates to a technology for printing by ejecting ink from an ejection head, and more particularly to a technology for circularly supplying ink to the ejection head by feeding the ink from a recovery tank to a supply tank by using a circulation pump while recovering the ink, which is supplied from the supply tank to the ejection head, into the recovery tank.

2. Description of the Related Art

A printer disclosed in Japanese Patent Application Laid Open Gazette No. 2020-44823 includes a supply tank and a recovery tank each connected to an ejection head and transfers ink from the supply tank to the recovery tank through the ejection head by reducing the pressure inside the recovery tank to be lower than that inside the supply tank. Further, the printer includes a circulation pump for feeding the ink from the recovery tank to the supply tank. With this configuration, generated is a circulation path of ink in which ink reaching the recovery tank from the supply tank through the ejection head is returned to the supply tank.

Furthermore, the printer includes a solenoid valve between the recovery tank and the supply tank. This solenoid valve shuts off the recovery tank and the supply tank from each other when energized and causes the recovery tank and the supply tank to communicate with each other when de-energized. With this configuration, the pressure difference between the recovery tank and the supply tank is cancelled when the circulation pump is stopped due to a power failure or the like and the flow of the ink from the supply tank to the recovery tank can be stopped. It is thereby possible to prevent the ink from overflowing from the recovery tank to any other portion.

SUMMARY OF THE INVENTION

In the above-described printer, with the communication between the recovery tank and the supply tank, a negative pressure inside the recovery tank increases. For this reason, the negative pressure inside the recovery tank becomes insufficient with respect to a water head pressure between the recovery tank and the ejection head, and the ink sometimes leaks from the ejection head.

The present invention is intended to solve the above problem, and it is an object of the present invention to provide a technology to make it possible to prevent leakage of ink from an ejection head when the pressure difference is cancelled between a supply tank for supplying ink to the ejection head and a recovery tank for recovering the ink from the ejection head.

A printer according to the invention, comprises: an ejection head which ejects ink from a nozzle; a recovery tank which stores ink recovered from the ejection head; a buffer part which communicates with the recovery tank; a supply tank which stores ink to be supplied to the ejection head; a first pressure applying part configured to apply a first pressure into the supply tank; a second pressure applying part configured to apply a second pressure which is a negative pressure lower than the first pressure into the recovery tank and the buffer part; a circulation pump which performs a liquid feed operation of feeding ink from the recovery tank to the supply tank, with supplied electric power; a bypass solenoid valve provided between the supply tank and the recovery tank, shutting off the supply tank and the recovery tank from each other when energized and causing the supply tank and the recovery tank to communicate with each other when de-energizes; and a power supply part configured to supply electric power to the circulation pump and the bypass solenoid valve, wherein the recovery tank is disposed above the ejection head, and the buffer part communicates with the recovery tank and the supply tank when the bypass solenoid valve is de-energized and causes a third pressure which is a negative pressure higher than the second pressure and lower than the first pressure to be generated in the recovery tank and the supply tank, to thereby prevent leakage of ink from the nozzle with the third pressure resisting a water head pressure between the recovery tank and the supply tank, and the nozzle of the ejection head.

A printing method according to the invention, comprises: supplying ink to an ejection head ejecting the ink from a nozzle to thereby perform printing, from a supply tank connected to the ejection head, and recovering the ink from the ejection head to a recovery tank connected to the ejection head by applying a first pressure into the supply tank and applying a second pressure which is a negative pressure lower than the first pressure into the recovery tank and a buffer part communicating with the recovery tank, feeding the ink from the recovery tank to the supply tank by supplying electric power to a circulation pump provided between the recovery tank and the supply tank, and causing a third pressure which is a negative pressure higher than the second pressure and lower than the first pressure to be generated in the recovery tank and the supply tank when the supply of the electric power to the circulation pump is stopped, by causing the recovery tank and the supply tank to communicate with each other and causing the buffer part to communicate with the recovery tank and the supply tank, to thereby prevent leakage of the ink from the nozzle with the third pressure resisting a water head pressure between the recovery tank and the supply tank, and the nozzle of the ejection head.

In the present invention (the printer and the printing method) having such a configuration, the buffer part communicating with the recovery tank is provided. Then, in the state where the recovery tank and the supply tank are shut off from each other, the first pressure is applied into the supply tank and the second pressure which is a negative pressure lower than the first pressure is applied into the recovery tank and the buffer part. In such a configuration, when the supply tank and the recovery tank communicate with each other, the difference between the first pressure inside the supply tank and the second pressure inside the recovery tank and the buffer part is cancelled, and the pressure inside the recovery tank increases. Since the buffer part is provided separately from the recovery tank, however, the increase range of the pressure inside the recovery tank is suppressed, as compared with the case where no buffer part is provided. Specifically, the third pressure which is a negative pressure higher than the second pressure and lower than the first pressure is generated in the recovery tank and the supply tank, and leakage of the ink from the nozzle can be prevented, with this third pressure resisting the water head pressure between the recovery tank and the supply tank, and the nozzle of the ejection head. Thus, it becomes possible to prevent leakage of the ink from the ejection head when the pressure difference is cancelled between the supply tank supplying the ink to the ejection head and the recovery tank recovering the ink from the ejection head.

A printing system according to the invention, comprises: the above printer; and a drying apparatus which dries ink ejected onto a printing medium by the printer. Also in such a printing system, it becomes possible to prevent leakage of ink from the ejection head when the pressure difference is cancelled between the supply tank supplying ink to the ejection head and the recovery tank recovering the ink from the ejection head.

Thus, according to the present invention, it becomes possible to prevent leakage of ink from the ejection head when the pressure difference is cancelled between the supply tank supplying ink to the ejection head and the recovery tank recovering the ink from the ejection head.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
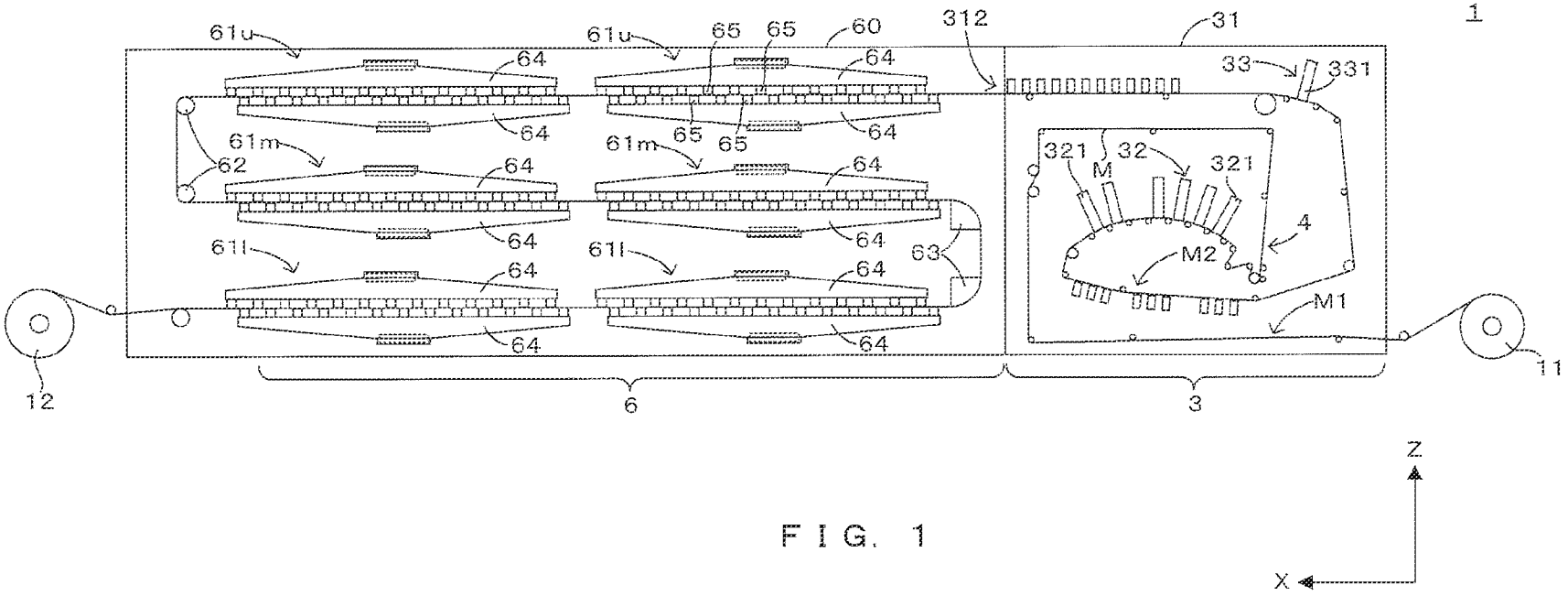
FIG. 1 is an elevational view schematically showing one example of a printing system in accordance with the present invention.

FIG. 1 is an elevational view schematically showing one example of a printing system in accordance with the present invention. In FIG. 1 and the following figures, a horizontal direction X and a vertical direction Z are shown as appropriate. As shown in FIG. 1, a printing system 1 includes a printer 3 and a drying apparatus 6 which are arranged in the horizontal direction X. The printing system 1 transfers a long strip-like printing medium M from a feed roll 11 to a wind-up roll 12 in a roll-to-roll manner. Further, the material of the printing medium M is a film such as OPP (oriented polypropylene), PET (polyethylene terephthalate), or the like. The material of the printing medium M, however, is not limited to the film but may be paper or the like. Such a printing medium M has flexibility. Furthermore, hereinafter, among both surfaces of the printing medium M, the surface on which an image is printed is referred to as a front surface M1 and the other surface opposite to the front surface M1 is referred to as a back surface M2 as appropriate.

The printer 3 ejects water-based ink by an inkjet method onto the front surface M1 of the printing medium M transferred from the feed roll 11 to the wind-up roll 12, to thereby print an image on the front surface M1 of the printing medium M. Detailed configuration of the printer 3 will be described later. The printing medium M on which the image is thus printed is transferred from the printer 3 to the drying apparatus 6 in the horizontal direction X.

The drying apparatus 6 includes a drying furnace 60 and dries the printing medium M unloaded from the printer 3 in the course of the transfer from the feed roll 11 to the wind-up roll 12. Inside the drying furnace 60, provided are two upper-stage blower units 61*u* arranged in the horizontal direction X, two middle-stage blower units 61*m* arranged in the horizontal direction X below these upper-stage blower units 61*u*, and two lower-stage blower units 611 arranged in the horizontal direction X below these middle-stage blower units 61*m*.

The printing medium M unloaded from an unloading port 312 of the printer 3 goes through the two upper-stage blower units 61*u* in the horizontal direction X and then are folded back toward the two middle-stage blower units 61*m* by a pair of rollers 62. Subsequently, the printing medium M goes through the two middle-stage blower units 61*m* in the horizontal direction X and then are folded back toward the two lower-stage blower units 611 by a pair of air turn bars 63. Further, the printing medium M goes through the two lower-stage blower units 611 in the horizontal direction X and then are unloaded to the outside of the drying apparatus 6.

The upper-stage blower unit 61*u* has two blower chambers 64 which are so disposed as to sandwich the printing medium M going in the horizontal direction X from the vertical direction Z. Each of the blower chambers 64 has a plurality of nozzles 65 arranged in the horizontal direction X and injects warm air (gas at 60° C. or more) from each of the nozzles 65 to the printing medium M. Thus, the printing medium M is dried by the warm air injected from the nozzles 65 of these blower chambers 64 while passing through between the two blower chambers 64 provided on the upper and lower sides. Further, each of the middle-stage blower unit 61*m* and the lower-stage blower unit 611 has two blower chambers 64 sandwiching the printing medium M from the vertical direction Z, like the upper-stage blower unit 61*u*.

Specific configuration of the upper-stage blower unit 61*u* is not limited to this exemplary one. For example, a plurality of rollers 62 arranged in the horizontal direction X may be provided, instead of the lower-side blower chamber 64 among the upper-side and lower-side blower chambers 64. In such a configuration, the warm air can be injected onto the front surface M1 of the printing medium M from the upper-side blower chamber 64 while the plurality of rollers support the back surface M2 of the printing medium M from below.

Figure 2:
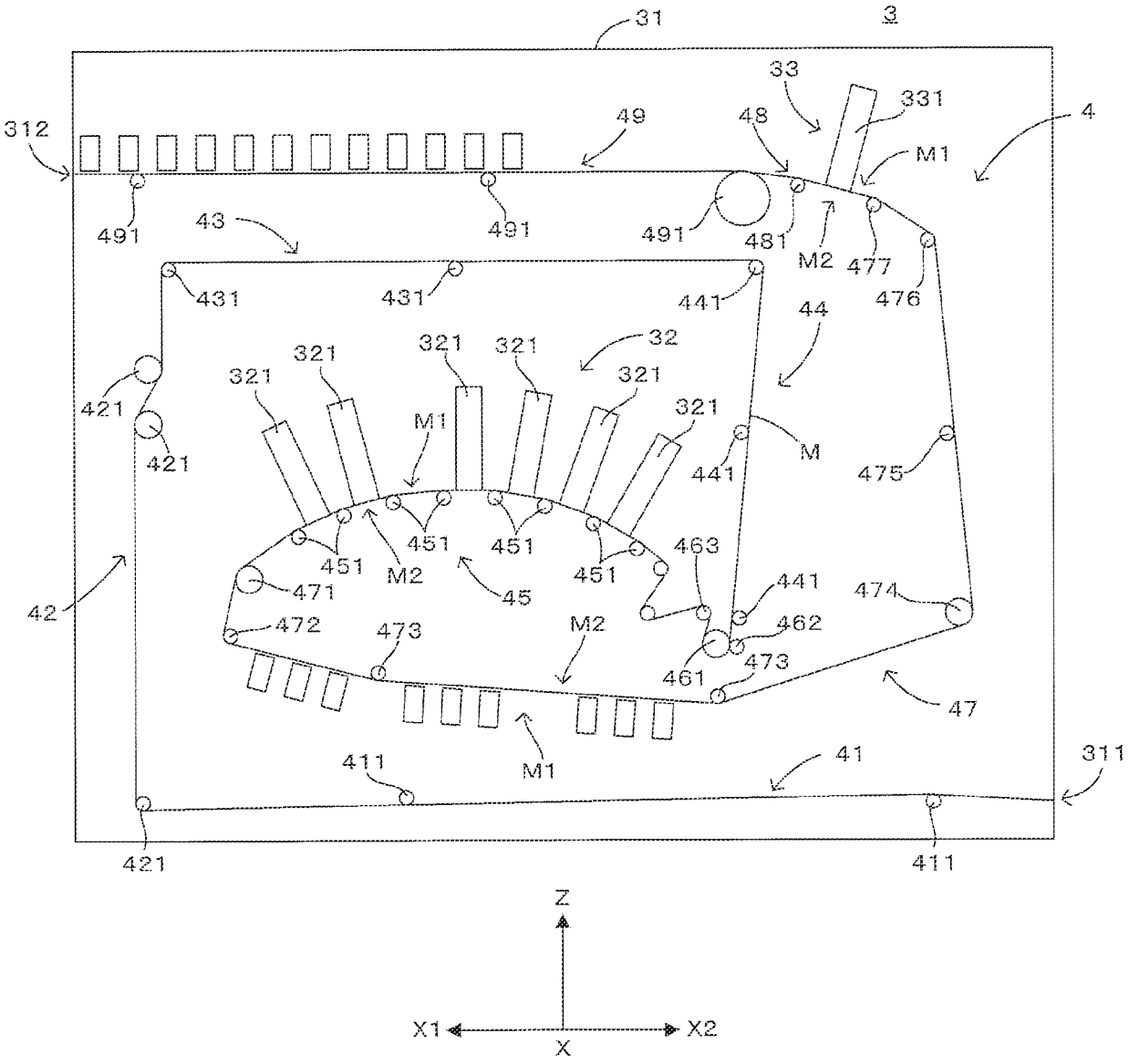
FIG. 2 is an elevational view schematically showing a printer included in the printing system of FIG. 1.

FIG. 2 is an elevational view schematically showing the printer included in the printing system of FIG. 1. In FIG. 2, one side X1 of the horizontal direction X and the other side X2 thereof are shown as appropriate. The one side X1 refers to a side toward the drying apparatus 6 from the printer 3 and the other side X2 refers to the opposite side of the one side X1. The printer 3 includes a cabinet 31, a color printing part 32 disposed inside the cabinet 31, a white printing part 33 disposed above the color printing part 32 inside the cabinet 31, and a transfer part 4 for transferring the printing medium M by using the plurality of rollers disposed inside the cabinet 31.

The color printing part 32 has a plurality of (six) ejection heads 321 arranged in a traveling direction of the printing medium M (direction toward the one side X1 from the other side X2) above the printing medium M transferred by the transfer part 4. The plurality of ejection heads 321 have nozzles facing, from above, the front surface M1 of the printing medium M going through therebelow, and eject color inks of different colors by an inkjet method from the nozzles. Herein, the color ink refers to ink other than white, including ink of cyan, magenta, yellow, black, or the like. Thus, the plurality of ejection heads 321 of the color printing part 32 eject color inks, from above, onto the front surface M1 of the printing medium M going through therebelow, to thereby print a color image on the printing medium M1 of the printing medium M.

Further, the white printing part 33 has a single ejection head 331 disposed above the printing medium M transferred by the transfer part 4. The ejection head 331 has a nozzle facing, from above, the front surface M1 of the printing medium M going through therebelow, and ejects white ink by an inkjet method from the nozzle. Thus, the ejection head 331 of the white printing part 33 ejects white ink, from above, onto the front surface M1 of the printing medium M going through therebelow, to thereby print a white image on the printing medium M1 of the printing medium M.

A loading port 311 is opened in a sidewall of the cabinet 31 on the other side X2, and the unloading port 312 is opened in a sidewall of the cabinet 31 on the one side X1. Then, the transfer part 4 transfers the printing medium M from the loading port 311 to the unloading port 312 through the color printing part 32 and the white printing part 33 described above.

The transfer part 4 has a loading part 41 provided below the color printing part 32, an upward transfer part 42 provided on the one side X1 of the color printing part 32, an upper transfer part 43 provided above the color printing part 32, and a downward transfer part 44 provided on the other side X2 of the color printing part 32. The loading part 41 transfers the printing medium M loaded from the loading port 311 toward the one side X1 by rollers 411, the upward transfer part 42 transfers the printing medium M transferred by the loading part 41, upward by rollers 421, the upper transfer part 43 transfers the printing medium M transferred by the upward transfer part 42 toward the other side X2 by rollers 431, and the downward transfer part 44 transfers the printing medium M transferred by the upper transfer part 43, downward by rollers 441.

Further, the transfer part 4 has a color transfer part 45 for supporting, from below, the printing medium M facing the color printing part 32, and the printing medium M which has passed through the downward transfer part 44 enters the color transfer part 45. The color transfer part 45 has a plurality of rollers 451 arranged from the other side X2 to the one side X1, and each of the rollers 451 comes into contact with the back surface M2 of the printing medium M from below. Thus, the front surface M1 of the medium M which is supported by the color transfer part 45 faces upward, and each of the ejection heads 321 of the color printing part 32 ejects color ink while facing this front surface M1 from above.

Furthermore, the transfer part 4 has rollers 461, 462, and 463 arranged between the color transfer part 45 and the downward transfer part 44 in the traveling direction of the printing medium M. The roller 461 is a driving roller to drive the printing medium M. Each of the rollers 462 and 463 is a driven roller which follows the printing medium M to rotate.

Further, the transfer part 4 has an inversion transfer part 47 which inverts the printing medium M transferred from the color transfer part 45 to the one side X1 upside down twice. This inversion transfer part 47 has a plurality of rollers 471 to 477 including a driving roller 471, and these rollers 471 to 477 invert the printing medium M upside down twice while coming into contact with the back surface M2 of the printing medium M. Specifically, the inversion transfer part 47 transfers the printing medium M transferred from the color transfer part 45 downward by the rollers 471 and 472, and changes the traveling direction of the printing medium M to the other side X2 by the roller 472 to transfer the printing medium M, to thereby invert the front surface M1 and the back surface M2 of the printing medium M upside down. Subsequently, the inversion transfer part 47 transfers the printing medium M from the one side X1 toward the other side X2 by the plurality of rollers 473, and next transfers the printing medium M upward by the rollers 474 to 476. Further, the inversion transfer part 47 changes the traveling direction of the printing medium M to the one side X1 by the roller 476, to thereby invert the front surface M1 and the back surface M2 of the printing medium M upside down again, and transfers the printing medium M from the other side X2 toward the one side X1 by the roller 477.

Furthermore, the transfer part 4 has a white transfer part 48 to support, from below, the printing medium M facing the white printing part 33, and the printing medium M inverted upside down twice by the inversion transfer part 47 enters the white transfer part 48. This white transfer part 48 has a roller 481 which comes into contact with the back surface M2 of the printing medium M from below. Thus, the front surface M1 of the printing medium M supported by the white transfer part 48 faces upward, and the ejection head 331 of the white printing part 33 ejects white ink while facing the front surface M1 from above.

Further, the transfer part 4 has an unloading part 49 provided above the upper transfer part 43. The unloading part 49 has a plurality of rollers 491 arranged from the other side X2 to the one side X1 in the horizontal direction X. The unloading part 49 transfers the printing medium M transferred by the white transfer part 48 toward the one side X1 by the plurality of rollers 491, to thereby unload the printing medium M from the unloading port 312 of the cabinet 31 to the drying apparatus 6.

As described above, the color printing part 32 and the white printing part 33 of the printer 3 have the ejection heads 321 and 331, respectively. Subsequently, an ink supply mechanism which supplies ink to these ejection heads 321 and 331 will be described. The basic configuration of the ink supply mechanism is common to the ejection heads 321 and 331. Then, description will be made, centering on the ejection head 331 for ejecting white ink. Hereinafter, each of the ejection heads 321 and 331 will be referred to as an ejection head H as appropriate.

Figure 3:
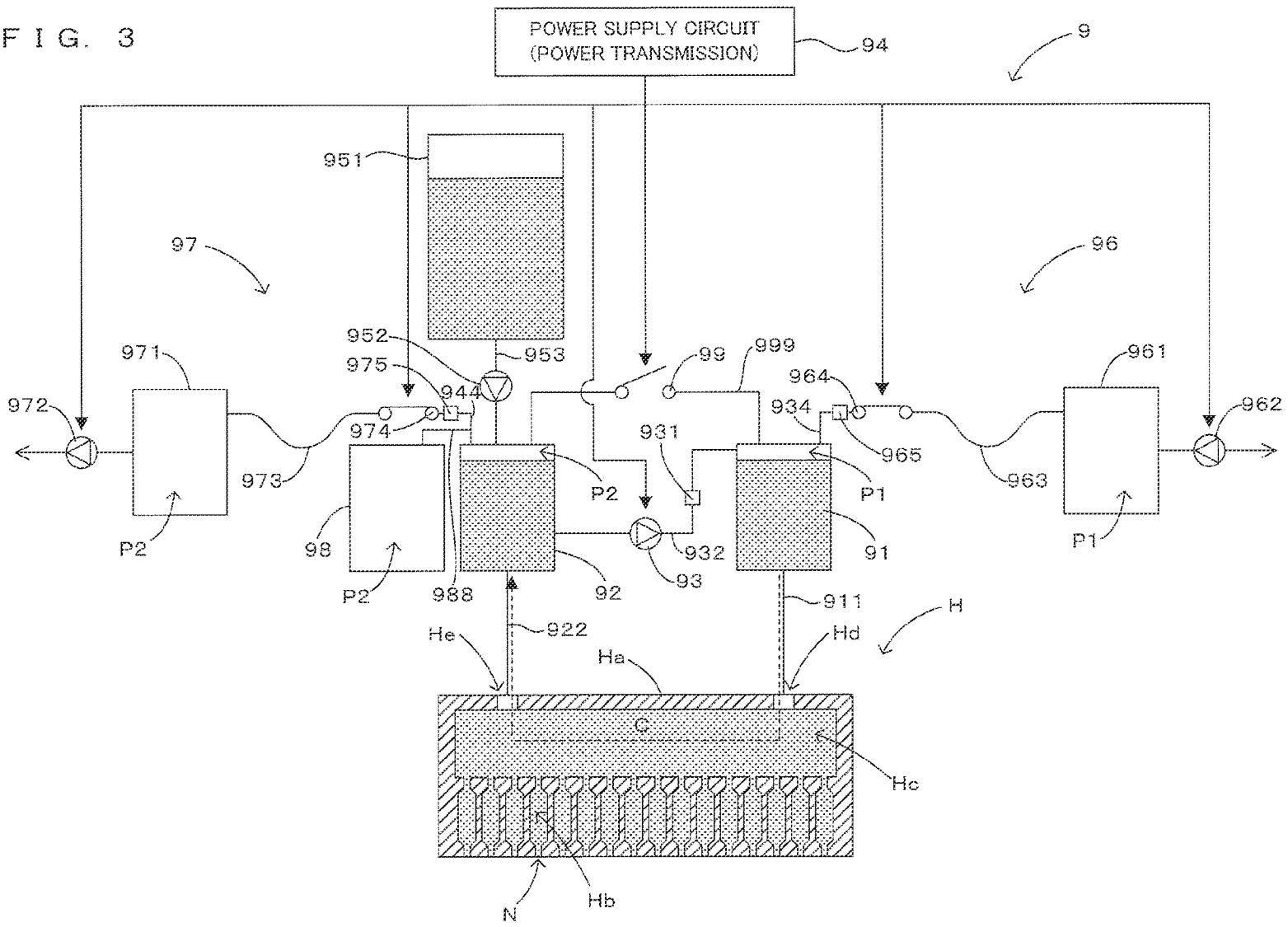
FIG. 3 is a view schematically showing a configuration of an ejection head and an ink supply mechanism for supplying ink to the ejection head.
Figure 4:
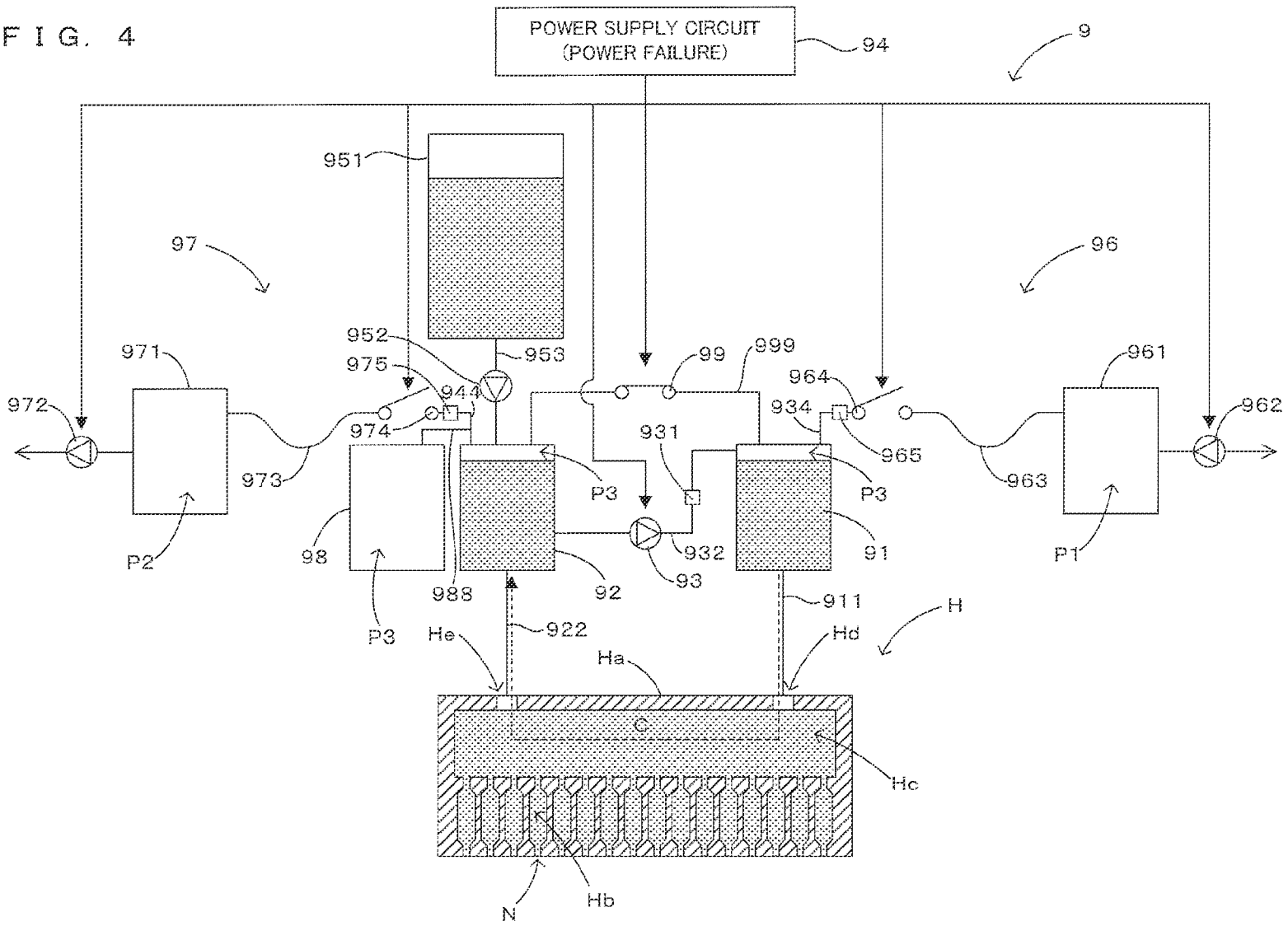
FIG. 4 is a view schematically showing another configuration of the ejection head and the ink supply mechanism for supplying ink to the ejection head.

FIGS. 3 and 4 are views each schematically showing a configuration of the ejection head and the ink supply mechanism which supplies ink to the ejection head, and FIG. 3 shows a state during power transmission and FIG. 4 shows a state during a power failure. As shown in these figures, the ejection head H has a housing Ha, and a plurality of nozzles N are arranged and opened in the bottom of the housing Ha. Inside the housing Ha, a plurality of cavities Hb communicating with the plurality of nozzles N, respectively, and an ink supply chamber Hc communicating with the plurality of cavities Hb are provided, and the ink supplied from the ink supply chamber Hc is stored in the cavities Hb. Then, a piezoelectric element provided in each of the cavities Hb extrudes the ink from the cavity Hb and the ink is thereby ejected from the nozzle N which communicates with the cavity Hb. Further, the specific method of ejecting the ink is not limited to the above method using the piezoelectric element but may be a thermal method in which the ink is heated. Furthermore, in an upper portion of the ejection head H, an ink inflow port Hd and an ink outflow port He are opened, and the ink flows into the ink supply chamber Hc from the ink supply mechanism 9 through the ink inflow port Hd and flows out from the ink supply chamber Hc through the ink outflow port He to the ink supply mechanism 9.

The ink supply mechanism 9 includes a supply tank 91 connected to the ink inflow port Hd through a pipe 911 and a recovery tank 92 connected to the ink outflow port He through a pipe 922, and the ink is stored in each of the supply tank 91 and the recovery tank 92. Each of the supply tank 91 and the recovery tank 92 is disposed above the ejection head H. The ink supply mechanism 9 includes a circulation pump 93 which is arranged to a pipe 932 connecting the recovery tank 92 and the supply tank 91 to feed the ink from the recovery tank 92 to the supply tank 91 and a degassing filter 931 arranged to the pipe 932 at a location between the circulation pump 93 and the supply tank 91, and the degassing filter 931 removes gas from the ink flowing out from the circulation pump 93 before flowing into the supply tank 91.

This ink supply mechanism 9 has a power supply circuit 94 which supplies electric power to the constituent elements of the apparatus. Then, the circulation pump 93 feeds the ink from the recovery tank 92 to the supply tank 91 by using the electric power supplied from the power supply circuit 94 (liquid feed operation). The circulation pump 93 thereby performs an ink circulation operation of circulating the ink in a circulation path C that leads from the recovery tank 92 through the supply tank 91 to the ink supply chamber Hc of the ejection head H and then returns to the recovery tank 92.

Further, the ink supply mechanism 9 includes a main tank 951 capable of storing a large amount of ink and a main pump 952 which is arranged to a pipe 953 connecting the main tank 951 and recovery tank 92 to feed the ink from the main tank 951 to the recovery tank 92. Then, when the amount of ink circulating in the circulation path C is reduced by the ejection of the ink from the nozzles N, the main pump 952 supplements the ink to the recovery tank 92 from the main tank 951 by using the electric power supplied from the power supply circuit 94.

Furthermore, the ink supply mechanism 9 includes a supply-side pressure applying part 96 (hereinafter, referred to as a "pressure applying part 96" as appropriate) which applies a positive pressure P1 to the supply tank 91. The pressure applying part 96 includes a pressure tank 961, a pump 962 applying the positive pressure P1 to the inside of the pressure tank 961 by supplying gas (air) to the pressure tank 961, and a flexible tube 963 having one end connected to the pressure tank 961. Then, in the pressure applying part 96, the pump 962 supplies gas to the pressure tank 961 by using the electric power supplied from the power supply circuit 94. The positive pressure P1 generated thus inside the pressure tank 961 by the pump 962 is given to the supply tank 91 through the tube 963 and further through the pipe 934.

On the other hand, inside the supply tank 91, gas (air) is accumulated above a liquid surface of the ink. In other words, inside the supply tank 91, the ink is stored below a gas-liquid interface and gas exists above the gas-liquid interface. Therefore, the positive pressure P1 is applied to the gas-liquid interface inside the supply tank 91 by the pressure applying part 96.

Further, the pressure applying part 96 includes a solenoid valve 964 provided between the other end of the tube 963 and one end of the pipe 934. This solenoid valve 964 is a valve of normally closed type. Therefore, during the power transmission shown in FIG. 3, the solenoid valve 964 forms a communication state in which an atmosphere in the pressure tank 961 communicates with an atmosphere in the supply tank 91 by using the electric power supplied from the power supply circuit 94 and the positive pressure P1 inside the pressure tank 961 is thereby given to the inside of the supply tank 91 through the tube 963, the solenoid valve 964 and pipe 934. On the other hand, during the power failure shown in FIG. 4, since the power supply from the power supply circuit 94 to the solenoid valve 964 is lost, the solenoid valve 964 forms a shut-off state in which an atmosphere in the pressure tank 961 is shut off from an atmosphere in the supply tank 91 and the application of the positive pressure P1 from the pressure tank 961 to the supply tank 91 is shut off.

Furthermore, the pressure applying part 96 has a check filter 965 between the pipe 934 and the solenoid valve 964. This check filter 965 inhibits passage of the ink from the supply tank 91 toward the pressure tank 961 while permitting passage of gas from the supply tank 91 toward the pressure tank 961. Thus, the check filter 965 prevents inflow of the ink from the supply tank 91 into the tube 963.

Further, the ink supply mechanism 9 includes a recovery-side pressure applying part 97 (hereinafter, referred to as a "pressure applying part 97" as appropriate) which applies a negative pressure to the recovery tank 92. The pressure applying part 97 includes a pressure tank 971, a pump 972 decompressing the inside of the pressure tank 971 by sucking gas (air) from the pressure tank 971, and a flexible tube 973 having one end connected to the pressure tank 971. Then, in the pressure applying part 97, the pump 972 exhausts gas from the inside of the pressure tank 971 by using the electric power supplied from the power supply circuit 94. The negative pressure P2 generated thus inside the pressure tank 971 by the pump 972 is given to the recovery tank 92 through the tube 973 and further through a pipe 944.

On the other hand, inside the recovery tank 92, gas (air) is accumulated above a liquid surface of the ink. In other words, inside the recovery tank 92, the ink is stored below a gas-liquid interface and gas exists above the gas-liquid interface. Therefore, the negative pressure P2 is applied to the gas-liquid interface inside the recovery tank 92 by the pressure applying part 97.

Furthermore, the pressure applying part 97 includes a solenoid valve 974 provided between the other end of the tube 973 and one end of the pipe 944. This solenoid valve 974 is a valve of normally closed type. Therefore, during the power transmission shown in FIG. 3, the solenoid valve 974 forms a communication state in which an atmosphere in the pressure tank 971 communicates with an atmosphere in the recovery tank 92 by using the electric power supplied from the power supply circuit 94 and the negative pressure P2 inside the pressure tank 971 is thereby given to the inside of the recovery tank 92 through the tube 973, the solenoid valve 974 and the pipe 944. On the other hand, during the power failure shown in FIG. 4, since the power supply from the power supply circuit 94 to the solenoid valve 974 is lost, the solenoid valve 974 forms a shut-off state in which an atmosphere in the pressure tank 971 is shut off from an atmosphere in the recovery tank 92 and the application of the negative pressure P2 from the pressure tank 971 to the recovery tank 92 is shut off.

Further, the pressure applying part 97 has a check filter 975 between the pipe 944 and the solenoid valve 974. This check filter 975 inhibits passage of the ink from the recovery tank 92 toward the pressure tank 971 while permitting passage of gas from the recovery tank 92 toward the pressure tank 971. Thus, the check filter 975 prevents inflow of the ink from the recovery tank 92 into the tube 973.

Further, the ink supply mechanism 9 has a buffer tank 98 communicating with the recovery tank 92 through a pipe 988. This buffer tank 98 communicates with above the gas-liquid interface of the recovery tank 92 (in other words, a layer of gas). In other words, the gas moves to and from between the buffer tank 98 and the recovery tank 92. On the other hand, the ink does not move to and from between the buffer tank 98 and the recovery tank 92 and there is no ink inside the buffer tank 98. During both the power transmission (FIG. 3) and the power failure (FIG. 4), an atmosphere in the buffer tank 98 and an atmosphere in the recovery tank 92 communicate with each other and the pressure inside the buffer tank 98 and that inside the recovery tank 92 are always equal to each other.

Specifically, during the power transmission shown in FIG. 3, the solenoid valve 974 forms the communication state in which an atmosphere in the pressure tank 971 communicates with an atmosphere in the buffer tank 98 by using the electric power supplied from the power supply circuit 94 and the negative pressure P2 inside the pressure tank 971 is thereby given to the inside of the buffer tank 98 through the tube 973, the solenoid valve 974, pipe 944 and pipe 988. On the other hand, during the power failure shown in FIG. 4, since the power supply from the power supply circuit 94 to the solenoid valve 974 is lost, the solenoid valve 974 forms the shut-off state in which an atmosphere in the pressure tank 971 is shut off from an atmosphere in the buffer tank 98 and the application of the negative pressure P2 from the pressure tank 971 to the buffer tank 98 is shut off.

During the power transmission shown in FIG. 3, the pressure P2 inside the recovery tank 92 and the buffer tank 98 is lower than the pressure P1 inside the supply tank 91, and the ink thereby moves from the supply tank 91 to the recovery tank 92 through the circulation path C. If this state continues, the liquid surface of the supply tank 91 becomes lower and the liquid surface of the recovery tank 92 becomes higher, and a meniscus required for the nozzle N of the ejection head H does not occur. Then, the circulation pump 93 circulates the ink from the recovery tank 92 to the supply tank 91, to thereby keep the respective liquid surfaces of the supply tank 91 and the recovery tank 92 at a constant level.

Further, the ink supply mechanism 9 includes a solenoid valve 99 provided to a pipe 999 connect the recovery tank 92 and the supply tank 91 to communicate an atmosphere in the recovery tank 92 with an atmosphere in the supply tank 91, and in other words, the solenoid valve 99 is provided in parallel with the circulation pump 93 between the recovery tank 92 and the supply tank 91. This solenoid valve 99 is a valve of normally open type. Therefore, during the power transmission shown in FIG. 3, the solenoid valve 99 is opened by using the electric power supplied from the power supply circuit 94 and the communication state between an atmosphere in the recovery tank 92 and an atmosphere in the supply tank 91 through the solenoid valve 99 is shut off. On the other hand, during the power failure shown in FIG. 4, since the power supply from the power supply circuit 94 to the solenoid valve 99 is lost, the solenoid valve 99 is closed and an atmosphere in the recovery tank 92 and an atmosphere in the supply tank 91 communicate with each other through the solenoid valve 99. Thereby, an upper-side (that is, layer of gas) above the gas-liquid interface in the recovery tank 92 and an upper-side (that is, layer of gas) above the gas-liquid interface in the supply tank 91 communicate with each other.

Thus, during the power failure (FIG. 4), when the solenoid valve 99 causes the recovery tank 92 and the supply tank 91 to communicate with each other, the pressure inside the recovery tank 92 and that inside the supply tank 91 each become a predetermined negative pressure P3. This negative pressure P3 is a negative pressure higher than the negative pressure P2 and lower than the positive pressure P1. During the power transmission (FIG. 3), the negative pressure P2 is applied into the buffer tank 98 in advance, and during the power failure (FIG. 4), the buffer tank 98 communicates with the recovery tank 92 and the supply tank 91. With such a function of the buffer tank 98, inside the recovery tank 92 and the supply tank 91, the negative pressure P3 is maintained to a certain extent during the power failure. On the other hand, as described above, the supply tank 91 and the recovery tank 92 are each disposed above the ejection head H. Therefore, between the gas-liquid interface of each of the recovery tank 92 and the supply tank 91 and the nozzle N of the ejection head H, a water head pressure in accordance with the level difference among these occurs. Then, the capacity which is large enough to generate the negative pressure P3 which can keep the ink against the water head pressure is provided in the buffer tank 98.

The ink supply mechanism 9 in accordance with the present embodiment described above circulates the ink in the circulation path C that leads from the recovery tank 92 through the supply tank 91 to the ejection head H and then returns to the recovery tank 92 by feeding the ink from the recovery tank 92 to the supply tank 91 by the circulation pump 93. Further, the solenoid valve 99 is provided between the supply tank 91 and the recovery tank 92 and shut off an atmosphere in the supply tank 91 from an atmosphere in the recovery tank 92 when energized (FIG. 3). Therefore, the solenoid valve 99 does not inhibit generation of the pressure difference (=P2−P1) between the supply tank 91 and the recovery tank 92. On the other hand, this solenoid valve 99 causes an atmosphere in the supply tank 91 and an atmosphere in the recovery tank 92 to communicate each other when de-energized (FIG. 4). Therefore, when the circulation pump 93 is stopped due to the power failure, it is possible to quickly cancel the pressure difference between the supply tank 91 and the recovery tank 92 and suppress the inflow of the ink from the supply tank 91 to the recovery tank 92 through the ink supply chamber Hc of the ejection head H.

Particularly, the buffer tank 98 (buffer part) whose atmosphere communicates with an atmosphere in the recovery tank 92 is provided. Then, in the state where an atmosphere in the recovery tank 92 and an atmosphere in the supply tank 91 are shut off from each other, the positive pressure P1 (first pressure) is applied into the supply tank 91 and the negative pressure P2 (second pressure) which is a pressure lower than the positive pressure P1 is applied into the recovery tank 92 and the buffer tank 98. In such a configuration, when an atmosphere in the supply tank 91 and an atmosphere in the recovery tank 92 communicate with each other, the difference between the positive pressure P1 inside the supply tank 91 and the negative pressure P2 inside the recovery tank 92 is cancelled and the pressure inside the recovery tank 92 increases. Since the buffer tank 98 is provided separately from the recovery tank 92, however, the increase range of the pressure inside the recovery tank 92 is suppressed, as compared with the case where no buffer tank 98 is provided. Specifically, the negative pressure P3 (third pressure) which is a pressure higher than the negative pressure P2 and lower than the positive pressure P1 occurs in the recovery tank 92 and the supply tank 91, and leakage of the ink from the nozzle N can be prevented, with the negative pressure P3 resisting the water head pressure between the recovery tank 92 and the supply tank 91, and the nozzle N of the ejection head H. It becomes possible to prevent leakage of the ink from the ejection head H when the pressure difference is cancelled between the supply tank 91 supplying the ink to the ejection head H and the recovery tank 92 recovering the ink from the ejection head H.

Further, the pressure applying part 96 (first pressure applying part) has the solenoid valve 964 (first solenoid valve) and the pressure tank 961 (first pressure tank) whose atmosphere can communicate with an atmosphere in the supply tank 91 through the solenoid valve 964 and applies the positive pressure P1 generated in the pressure tank 961 to the supply tank 91 through the solenoid valve 964. Then, the solenoid valve 964 causes an atmosphere in the supply tank 91 and an atmosphere in the pressure tank 961 to communicate with each other when energized and shuts off an atmosphere in the supply tank 91 and an atmosphere in the pressure tank 961 from each other when de-energized. Furthermore, the pressure applying part 97 (second pressure applying part) has the solenoid valve 974 (second solenoid valve) and the pressure tank 971 (second pressure tank) whose atmosphere can communicate with an atmosphere in the recovery tank 92 (and buffer tank 98) through the solenoid valve 974 and applies the negative pressure P2 generated in the pressure tank 971 to the recovery tank 92 and the buffer tank 98 through the solenoid valve 974. Then, the solenoid valve 974 causes an atmosphere in the recovery tank 92 and the buffer tank 98, and an atmosphere in the pressure tank 971 to communicate with each other when energized and shuts off an atmosphere in the recovery tank 92 and the buffer tank 98, and an atmosphere in the pressure tank 971 from each other during de-energized. In such a configuration, with the communication between an atmosphere in the supply tank 91 and an atmosphere in the recovery tank 92 during the power failure, an atmosphere in the pressure tank 961 and the pressure tank 971 are cut off from an atmosphere in the supply tank 91, the recovery tank 92, and the buffer tank 98. Therefore, it is possible to reliably generate the negative pressure P3 required to prevent the leakage of the ink from the ejection head H in each of the supply tank 91, the recovery tank 92, and the buffer tank 98.

Further, during the power transmission shown in FIG. 3, the positive pressure P1 is applied to the supply tank 91. Thus, in the configuration where the positive pressure P1 is generated in the supply tank 91, there is a tendency that the above-described problem of the leakage of the ink becomes noticeable. Therefore, as described above, the configuration in which the buffer tank 98 is provided is particularly preferable.

Furthermore, in the ink supply mechanism 9 with respect to the ejection head H for ejecting white ink, by applying the positive pressure P1 to the supply tank 91, the following advantage rises. Specifically, white ink is used for printing of a so-called solid image forming a background or the like in most cases. In a case of printing such a solid image, when the amount of white ink ejected from the ejection head H is short, an image failure in which areas with no white ink deposited appear in streaks can occur. In order to prevent this, by applying the positive pressure P1 into the supply tank 91, sufficient amount of white ink can be ejected from the ejection head H and it is thereby possible to print a preferable solid image.

In the above-described embodiment, the printing system 1 corresponds to one example of a "printing system" of the present invention, the printer 3 corresponds to one example of a "printer" of the present invention, the drying apparatus 6 corresponds to one example of a "drying apparatus" of the present invention, the supply tank 91 corresponds to one example of a "supply tank" of the present invention, the recovery tank 92 corresponds to one example of a "recovery tank" of the present invention, the circulation pump 93 corresponds to one example of a "circulation pump" of the present invention, the power supply circuit 94 corresponds to one example of a "power supply part" of the present invention, the pressure applying part 96 corresponds to one example of a "first pressure applying part" of the present invention, the pressure tank 961 corresponds to one example of a "first pressure tank" of the present invention, the solenoid valve 964 corresponds to one example of a "first solenoid valve" of the present invention, the pressure applying part 97 corresponds to one example of a "second pressure applying part" of the present invention, the pressure tank 971 corresponds to one example of a "second pressure tank" of the present invention, the solenoid valve 974 corresponds to one example of a "second solenoid valve" of the present invention, the buffer tank 98 corresponds to one example of a "buffer part" of the present invention, the solenoid valve 99 corresponds to one example of a "bypass solenoid valve" of the present invention, the ejection head H corresponds to one example of an "ejection head" of the present invention, the nozzle N corresponds to one example of a "nozzle" of the present invention, the positive pressure P1 corresponds to one example of a "first pressure" of the present invention, the negative pressure P2 corresponds to one example of a "second pressure" of the present invention, and the negative pressure P3 corresponds to one example of a "third pressure" of the present invention.

Further, the present invention is not limited to the above-described embodiment, but numerous modifications and variations other than those described above can be devised without departing from the scope of the invention. For example, the pressure applied from the pressure tank 961 of the pressure applying part 96 to the supply tank 91 does not need to be a positive pressure but may be a negative pressure. In the ink supply mechanism 9 for supplying the ink to the ejection head H which ejects color ink, particularly, a negative pressure (first pressure) higher than the negative pressure P2 may be applied to the supply tank 91 during the power transmission.

Further, as the "buffer part" to which the negative pressure P2 is applied in advance during the power transmission, a redundant pipe may be provided, instead of the above-described buffer tank 98.

Furthermore, the solenoid valve 974, the solenoid valve 964, and the solenoid valve 99 described above do not need to be each formed as a single valve but may be collectively formed as a multi-way valve.

The present invention can be applied to general printing technology.

As described above, the printer may be configured so that the first pressure applying part has a first solenoid valve and a first pressure tank which is connected to the supply tank through the first solenoid valve and applies the first pressure generated in the first pressure tank to the supply tank through the first solenoid valve, the first solenoid valve causes the supply tank and the first pressure tank to communicate with each other when energized and shuts off the supply tank and the first pressure tank from each other when de-energized, the second pressure applying part has a second solenoid valve and a second pressure tank which is connected to the recovery tank through the second solenoid valve and applies the second pressure generated in the second pressure tank to the recovery tank through the second solenoid valve, and the second solenoid valve causes the recovery tank and the second pressure tank to communicate with each other when energized and shuts off the recovery tank and the second pressure tank from each other when de-energized. In such a configuration, with the communication between the supply tank and the recovery tank, the first and second pressure tanks are shut off from the supply tank, the recovery tank, and the buffer part. Therefore, it is possible to reliably generate the third pressure required to prevent the leakage of the ink from the ejection head in each of the supply tank, the recovery tank, and the buffer part.

The printer may be configured so that the first pressure is a positive pressure. In the configuration where a positive pressure is generated in the supply tank, there is a tendency that the above-described problem of the leakage of the ink becomes noticeable. Therefore, it is particularly preferable that the present invention should be applied to such a configuration.

The printer may be configured so that the ink is white ink. White ink is used for printing of a so-called solid image forming a background or the like in most cases. In a case of printing such a solid image, when the amount of white ink ejected from the ejection head is short, an image failure in which areas with no white ink deposited appear in streaks can occur. In order to prevent this, by applying a positive pressure into the supply tank, sufficient amount of white ink can be ejected from the ejection head, and it is thereby possible to print a preferable solid image.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printer, comprising:

an ejection head which ejects ink from a nozzle;

a recovery tank which stores ink recovered from the ejection head;

a buffer part which communicates with the recovery tank;

a supply tank which stores ink to be supplied to the ejection head;

a first pressure applying part configured to apply a first pressure into the supply tank;

a second pressure applying part configured to apply a second pressure which is a negative pressure lower than the first pressure into the recovery tank and the buffer part;

a circulation pump which performs a liquid feed operation of feeding ink from the recovery tank to the supply tank, with supplied electric power;

a bypass solenoid valve provided between the supply tank and the recovery tank, shutting off the supply tank and the recovery tank from each other when energized and causing the supply tank and the recovery tank to communicate with each other when de-energizes; and a power supply part configured to supply electric power to the circulation pump and the bypass solenoid valve, wherein the recovery tank is disposed above the ejection head, and the buffer part communicates with the recovery tank and the supply tank when the bypass solenoid valve is de-energized and causes a third pressure which is a negative pressure higher than the second pressure and lower than the first pressure to be generated in the recovery tank and the supply tank, to thereby prevent leakage of ink from the nozzle with the third pressure resisting a water head pressure between the recovery tank and the supply tank, and the nozzle of the ejection head.

2. The printer according to claim 1, wherein the first pressure applying part has a first solenoid valve and a first pressure tank which is connected to the supply tank through the first solenoid valve and applies the first pressure generated in the first pressure tank to the supply tank through the first solenoid valve, the first solenoid valve causes the supply tank and the first pressure tank to communicate with each other when energized and shuts off the supply tank and the first pressure tank from each other when de-energized, the second pressure applying part has a second solenoid valve and a second pressure tank which is connected to the recovery tank through the second solenoid valve and applies the second pressure generated in the second pressure tank to the recovery tank through the second solenoid valve, and the second solenoid valve causes the recovery tank and the second pressure tank to communicate with each other when energized and shuts off the recovery tank and the second pressure tank from each other when de-energized.

3. The printer according to claim 1, wherein the first pressure is a positive pressure.

4. The printer according to claim 3, wherein the ink is white ink.

5. A printing system, comprising:

the printer according to claim 1; and a drying apparatus which dries ink ejected onto a printing medium by the printer.

6. A printing method, comprising:

supplying ink to an ejection head ejecting the ink from a nozzle to thereby perform printing, from a supply tank connected to the ejection head, and recovering the ink from the ejection head to a recovery tank connected to the ejection head by applying a first pressure into the supply tank and applying a second pressure which is a negative pressure lower than the first pressure into the recovery tank and a buffer part communicating with the recovery tank, feeding the ink from the recovery tank to the supply tank by supplying electric power to a circulation pump provided between the recovery tank and the supply tank, and causing a third pressure which is a negative pressure higher than the second pressure and lower than the first pressure to be generated in the recovery tank and the supply tank when the supply of the electric power to the circulation pump is stopped, by causing the recovery tank and the supply tank to communicate with each other and causing the buffer part to communicate with the recovery tank and the supply tank, to thereby prevent leakage of the ink from the nozzle with the third pressure resisting a water head pressure between the recovery tank and the supply tank, and the nozzle of the ejection head.

* * * * *